US009107555B2

(12) United States Patent
Slinkard

(10) Patent No.: US 9,107,555 B2
(45) Date of Patent: Aug. 18, 2015

(54) WATER BROOM

(75) Inventor: Paul Slinkard, Centennial, CO (US)

(73) Assignee: Meridian International Co., Ltd. (CN)

( * ) Notice: Subject to any disclaimer, the term of this patent is extended or adjusted under 35 U.S.C. 154(b) by 1220 days.

(21) Appl. No.: 13/028,767

(22) Filed: Feb. 16, 2011

(65) Prior Publication Data

US 2012/0204915 A1 Aug. 16, 2012

(51) Int. Cl.

| | |
|---|---|
| ***B08B 3/00*** | (2006.01) |
| ***A47L 13/26*** | (2006.01) |
| ***B05B 1/20*** | (2006.01) |
| ***B05B 15/06*** | (2006.01) |
| ***E01H 1/10*** | (2006.01) |

(52) U.S. Cl.

CPC ..... *A47L 13/26* (2013.01); *B05B 1/202* (2013.01); *B05B 15/065* (2013.01); *E01H 1/101* (2013.01)

(58) Field of Classification Search

CPC ..... B05B 1/202; B05B 15/065; E01H 1/101; A47L 13/26

USPC ..... 134/198; 239/754; 401/289

See application file for complete search history.

(56) References Cited

U.S. PATENT DOCUMENTS

| | | | | | |
|---|---|---|---|---|---|
| 2,581,678 | A | * | 1/1952 | Malin et al. | 239/104 |
| 2,638,730 | A | * | 5/1953 | Davidson | 56/400.14 |
| 2,692,163 | A | * | 10/1954 | Geel | 239/754 |
| 2,746,072 | A | * | 5/1956 | Lumpkin | 401/48 |
| 2,911,157 | A | * | 11/1959 | Converse | 239/754 |
| 3,118,607 | A | * | 1/1964 | Rocher | 239/104 |
| 3,377,123 | A | * | 4/1968 | Leeson | 401/139 |
| 3,508,709 | A | * | 4/1970 | Serbousek et al. | 239/754 |
| 3,748,050 | A | * | 7/1973 | Poppitz | 401/289 |
| 3,832,069 | A | * | 8/1974 | Petsch | 401/289 |
| 4,083,495 | A | * | 4/1978 | Sharp | 239/754 |
| 4,095,746 | A | * | 6/1978 | Anderberg et al. | 239/754 |
| 4,200,236 | A | * | 4/1980 | Briar | 15/361 |
| 4,629,347 | A | * | 12/1986 | Poppitz | 401/42 |
| 4,930,706 | A | * | 6/1990 | Merlin | 239/754 |
| 4,962,892 | A | * | 10/1990 | Sauer | 239/722 |
| 5,152,126 | A | * | 10/1992 | Cousineau | 37/342 |
| 5,305,585 | A | * | 4/1994 | Cousineau | 56/8 |
| 5,449,303 | A | * | 9/1995 | McLeod | 239/754 |
| 5,707,014 | A | | 1/1998 | Chan et al. | |
| 5,908,163 | A | * | 6/1999 | Wells | 239/722 |
| 6,413,002 | B1 | * | 7/2002 | Delaine, Jr. | 401/289 |
| 6,419,415 | B1 | * | 7/2002 | Vosbikian et al. | 401/289 |
| 6,474,896 | B1 | * | 11/2002 | DeLaine, Jr. | 401/289 |
| 6,786,431 | B2 | * | 9/2004 | Song | 239/526 |
| 7,891,036 | B2 | * | 2/2011 | Hahn et al. | 15/50.3 |
| 2003/0010852 | A1 | * | 1/2003 | Schommer | 239/754 |
| 2003/0180085 | A1 | * | 9/2003 | Hughes | 401/289 |
| 2006/0222438 | A1 | * | 10/2006 | Alexander et al. | 401/48 |

* cited by examiner

*Primary Examiner* — Michael Barr
*Assistant Examiner* — Benjamin L Osterhout
(74) *Attorney, Agent, or Firm* — Jason R. Sytsma; Shuttleworth & Ingersoll, PLC

(57) ABSTRACT

A surface cleaning apparatus is disclosed. The cleaning apparatus connects to a liquid source under pressure, such as a garden hose, and disperses liquid on to a surface to remove debris from the surface. The surface cleaning apparatus comprises a handle member and a manifold. The manifold is connected to the liquid source at one end and the other end is connected to the manifold. The manifold has a right and a left section each of which is pivotally combined to the handle member. The right and left sections rotate between an extended position substantially perpendicular to the handle member and a retracted position parallel with the handle member.

19 Claims, 5 Drawing Sheets

WATER BROOM

BACKGROUND

This invention relates to a water sweeper or broom which is self-supported on a surface to remove debris from a surface; and more specifically to a water sweeper or broom that collapses to a smaller size for displaying at a point of sale or for storage.

Large flat surfaces, such as driveways, side-walks, pool decks, tennis courts and the like, are often difficult to clean quickly. One conventional way of cleaning such surfaces is to use a push broom or sweep broom. Unfortunately, using a conventional broom can be very tiring for the operator, and to remove all of the dirt with a broom, it is often necessary to go back over the area a number of times. Another method that is often employed is to use a spray of water from a garden hose to move the dirt and debris. However, the lone stream from a garden hose cannot clean large areas very quickly. Since neither of these methods has proven efficient for cleaning large flat surfaces quickly, it has been found advantageous to combine elements of a push broom with elements of a water sprayer in a device known as a water broom.

Water brooms having the width of a broom take up a lot of useable space. This is especially problematic at the point of sale where space is at a premium. Retailers are especially reluctant to market such brooms due to the their wide expanse. Accordingly, a water broom is needed which conveniently collapses to a manageable size for storing and displaying at the point of sale.

SUMMARY

A surface cleaning apparatus is disclosed. The cleaning apparatus connects to a liquid source under pressure, such as a garden hose, and disperses liquid on to a surface to remove debris from the surface. The surface cleaning apparatus comprises a handle member and a manifold. The manifold is connected to the liquid source at one end and the other end is connected to the manifold. The manifold has a right and a left section each of which is pivotally combined to the handle member. The right and left sections rotate between an extended position substantially perpendicular to the handle member and a retracted position parallel with the handle member.

In one embodiment, the elongated handle member is a telescoping elongated handle member that moves telescopingly between an extended position to a retracted position. In another embodiment, the handle member comprises a base member and a foldable member pivotally combined to the base member and moveable in a semicircular arc between an extended position and a retracted position parallel to the base member.

The surface cleaning apparatus includes at least one roller combined to the manifold and positioned behind the direction of flow of the liquid under pressure from the nozzles to the surface so as not to disrupt the flow of the liquid to the surface. The roller engages a ground surface to facilitate movement of the apparatus across the ground surface as liquid under pressure is directed out of the nozzles to the surface for moving debris across the surface.

BRIEF DESCRIPTION OF THE DRAWINGS

For a more complete understanding of particular embodiments and their features and advantages, reference is now made to the following description, taken in conjunction with the accompanying drawings, in which.

DETAILED DESCRIPTION OF THE ILLUSTRATIVE EMBODIMENTS

Figure 1:
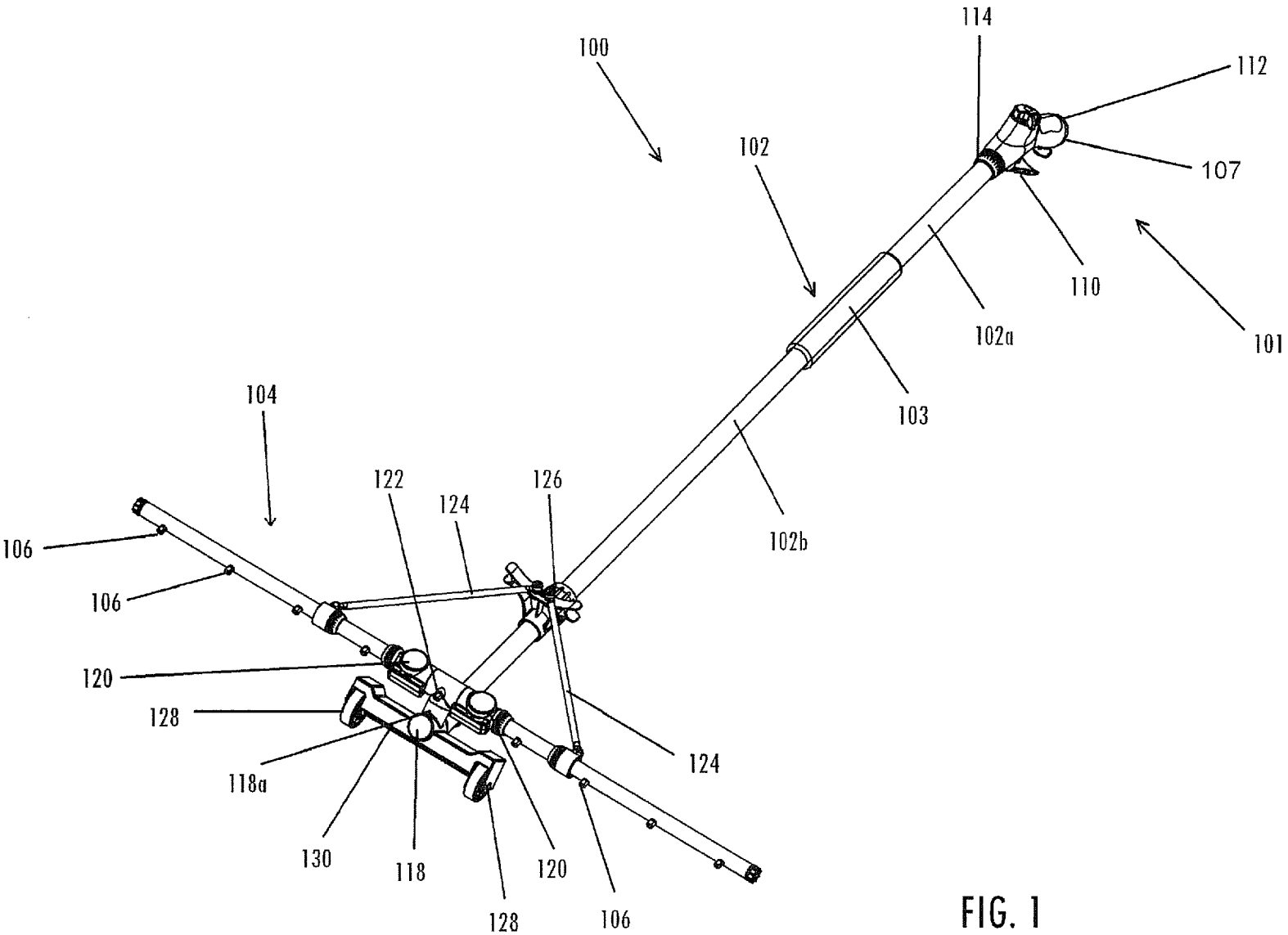
FIG. 1 is a perspective view of a water broom in accordance with a first embodiment illustrated in an extended and operative position.

FIGS. 1-5 illustrate two embodiments of the present invention of a surface cleaning apparatus or water broom 100. The water broom 100 is comprised generally of a handle member 102 and a manifold 104 with a plurality of nozzles 106 spaced apart along the length of manifold 104. A source, such as a garden hose, supplies liquid under pressure to handle member 102 by way of a coupler 107. In operation, water from the source is directed through handle member 102 divided toward respective ends of manifold 104 out through nozzles 106 and onto the surface being cleaned.

A handle member coupling 114 couples handle member 102 to a valve 101 with a manually operated lever 110 and an ergonomic grip 112. Lever 110 has an opening to allow water under pressure to pass therethrough. A preferred type of valve 101 has lever 110 biased to the closed position. Valve 101 must be manually operated to the open position and when manual pressure is removed from lever 110, valve 101 is closed. Valve 101 is, in turn, shown coupled through a standard hose coupling 107 to a hose (not shown) that is connected to a water source. Valve 101 enables an operator of the water sweeper to use and operate the sweeper with one hand.

Handle member 102 is collapsible from an extended position to a retracted position. Referring to FIG. 1, which illustrates a first embodiment, handle member 102 is a telescoping handle member 102 that telescopically collapses to reduce the length of water sweeper 100. Handle member 102 has an upper portion 102*a* and a lower portion 102*b* with the lower portion 102*b* having an outer diameter slightly smaller than an inner diameter of upper portion 102*a* to allow upper portion 102*a* to telescopically extend and retract from lower portion 102*b*. A sleeve 103 covers the telescopic joint and provides an ergonomic grip.

Figure 4:
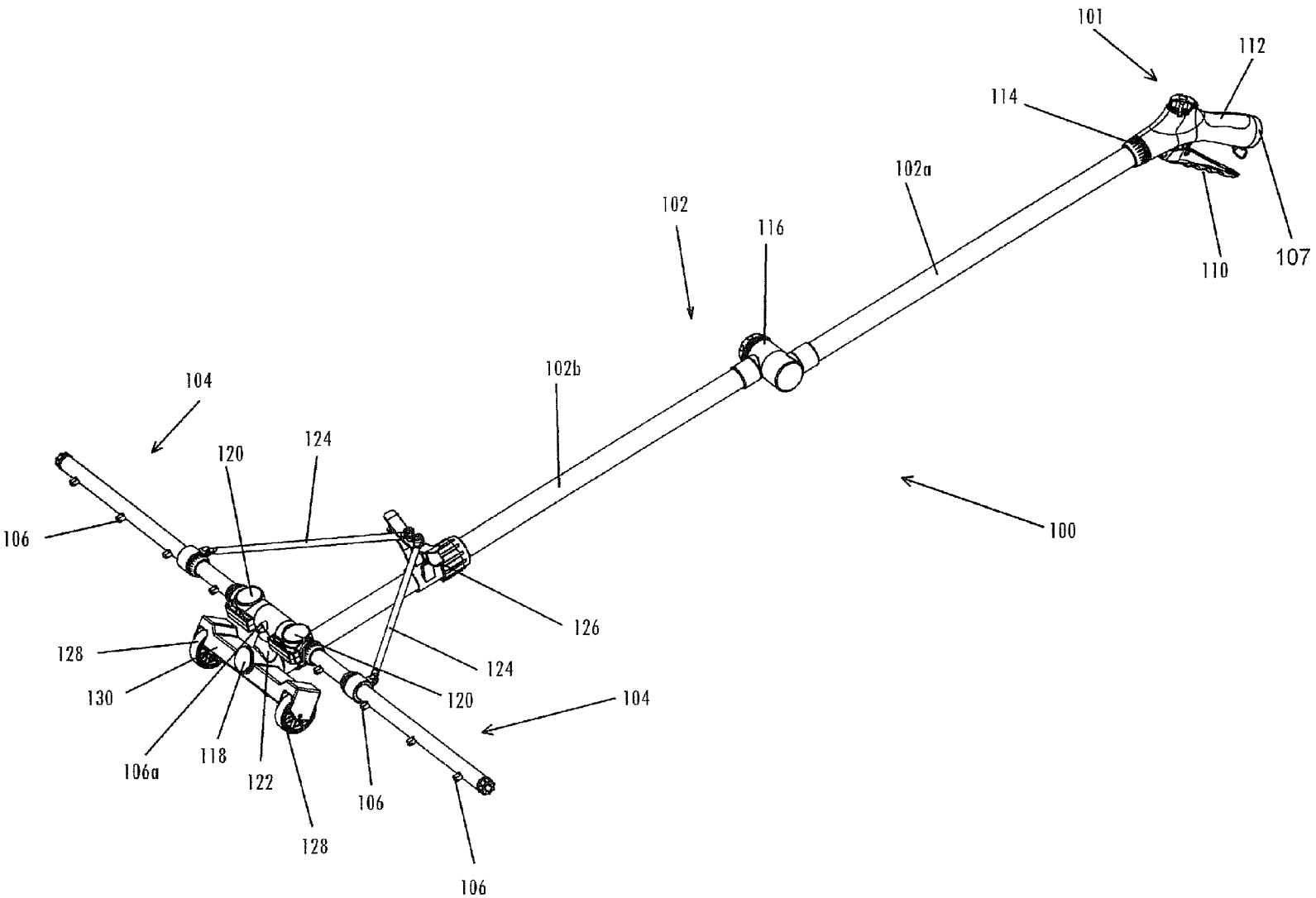
FIG. 4 is a perspective view of a water broom in accordance with a second embodiment illustrated in an extended and operative position.
Figure 5:
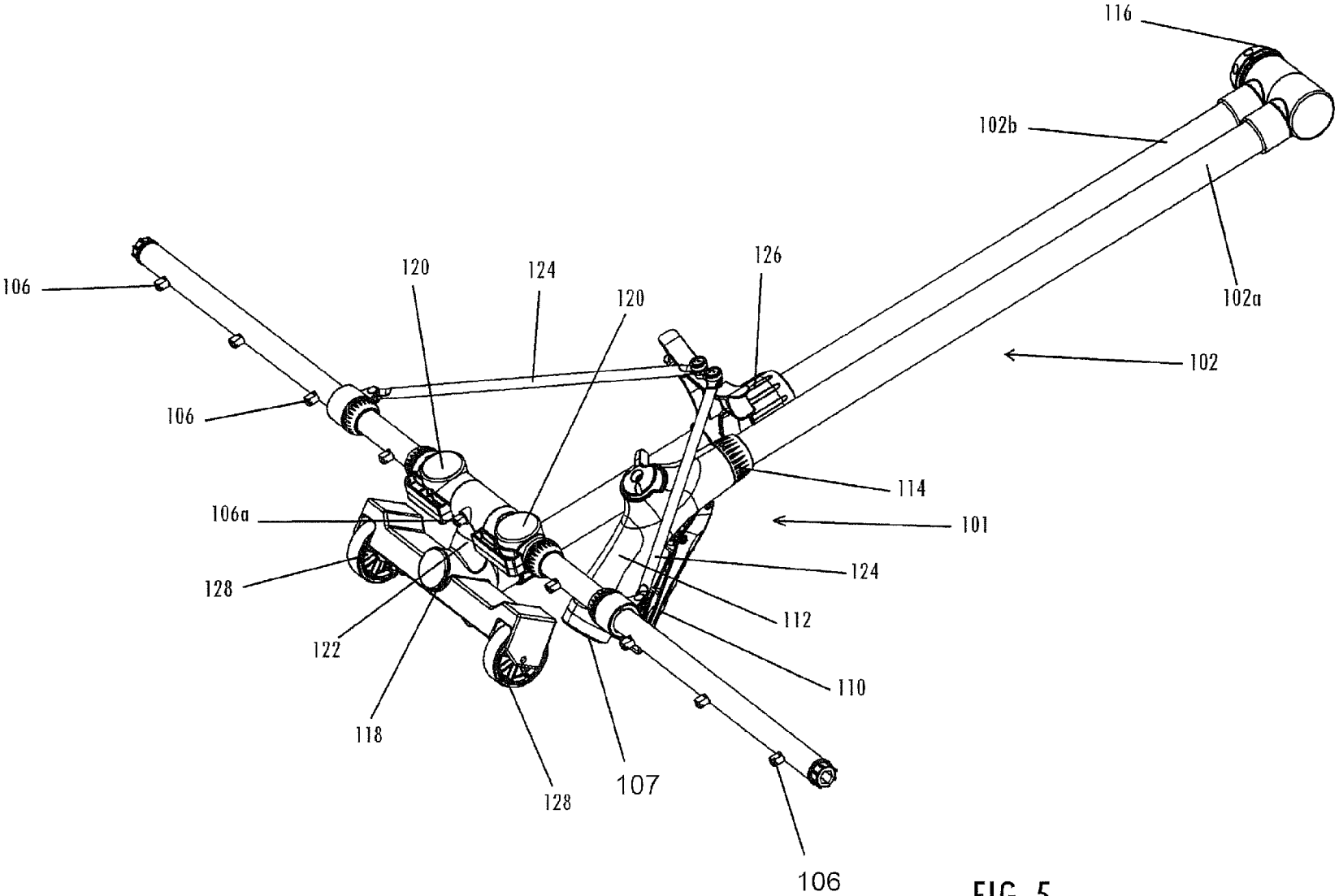
FIG. 5 is a the water broom of FIG. 4 in the retracted position.

Referring to the second embodiment illustrated in FIGS. 4 & 5, handle member 102 collapses by folding in half. A joint 116 combines a foldable upper portion 102*a* and a lower base portion 102*b* which allows foldable portion 102*a* to rotate in a semicircular arc between a first position extended from base portion 102*b* to a second position parallel to base portion 102*b*. Joint 116 is adapted to allow unrestricted fluid communication between the respective handle member portions 102*a*, 102*b* and movement between respective positions. In both embodiments, handle member 102 collapses to a retracted position for storing or displaying at the point of sale.

In either of the embodiments, an elbow joint 118 is attached at the end of handle member 102 opposite that carrying coupling 114. Elbow joint 118 extends from handle member 102 and curves toward a linear position parallel with the ground surface. A T-shaped coupler 122 is combined to the upper side of elbow joint 118 to direct fluid from elbow joint 118 upward into manifold 104.

Two pivoting flow joints 120 are positioned on opposing sides of T-shaped coupler 122 and combine opposing ends of manifold 104. Pivoting flow joints 120 rotate 90° from a position in line with the longitudinal portion of T-shaped coupler 122 to a perpendicular position with respect to longitudinal portion of T-shaped coupler 122. An internal passage through pivoting flow joints 120 opens and closes as pivoting flow joints 120 rotate between the inline position and the perpendicular position.

Figure 2:
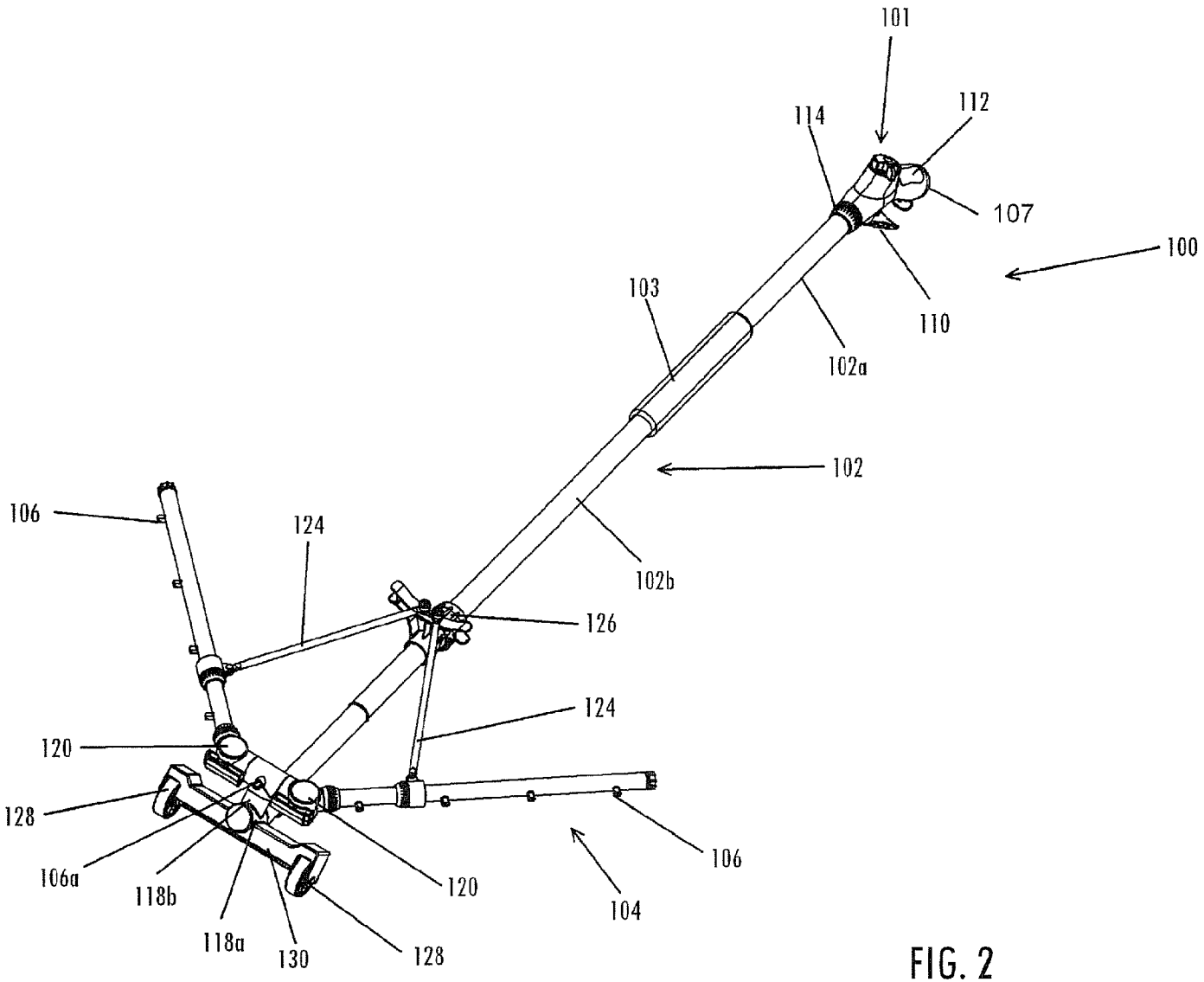
FIG. 2 is the water broom of FIG. 1 in a partially retracted position.
Figure 3:
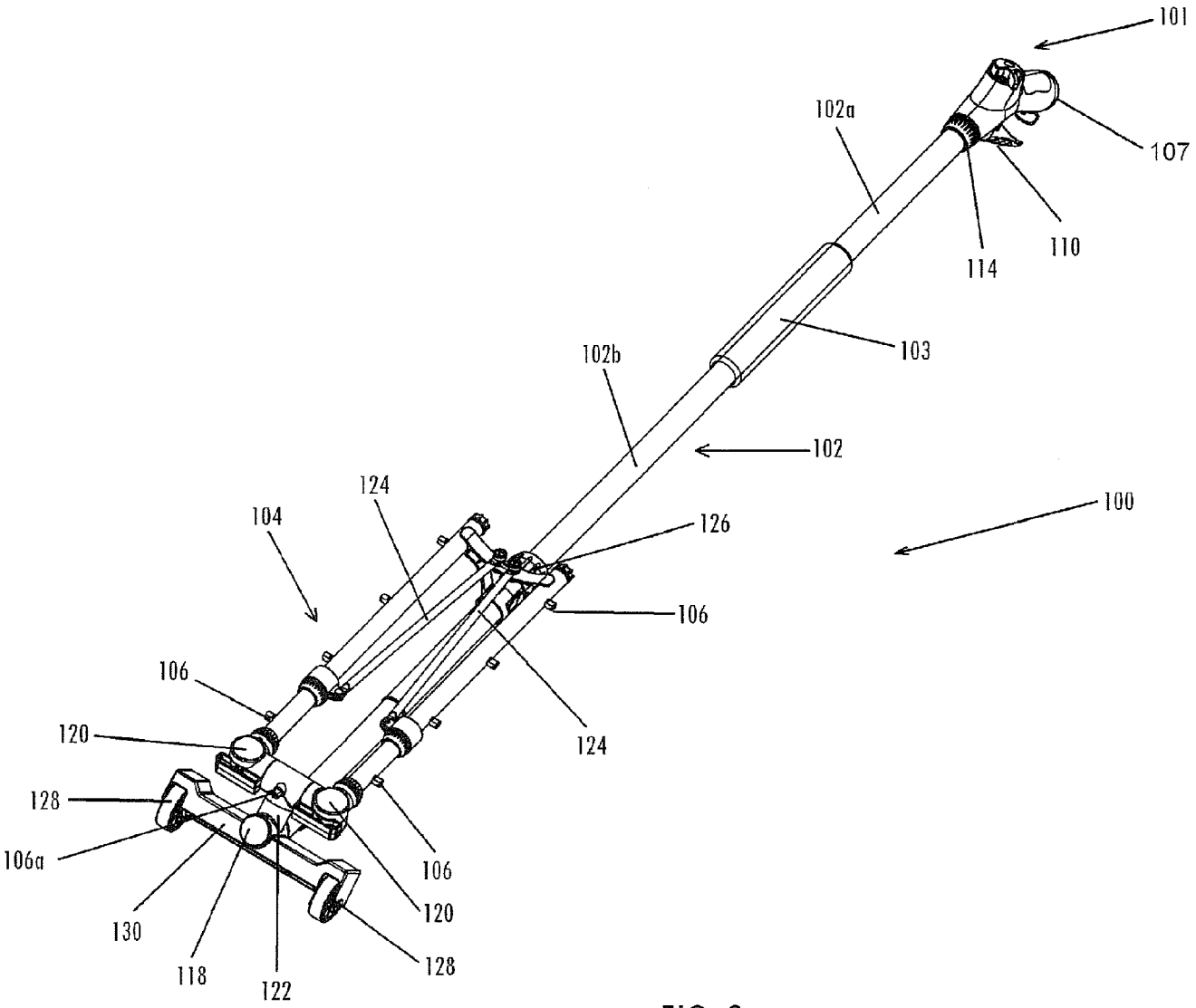
FIG. 3 is the water broom of FIG. 1 in the retracted position.

A pair of support members 124 combine handle member 102 with manifold 104. Support member 124 are pivotally connected to a sliding coupling 126 that moves axially up and down handle member 102. Sliding coupling 126 has an internal diameter slightly larger than an external diameter of lower portion 102*b* of handle member 102. This allows sliding coupling 126 to move up and down handle member 102. Opposite ends of support members 124 are pivotally combined to manifold 104. In the extended position, as shown in FIG. 1, two right triangles are formed between handle member 102, respective support members 124, and manifold 104. As shown in FIGS. 1 and 2, as sliding coupling 126 is moved up handle member 102, respective ends of manifold 104 are brought to the retracted position.

A plurality of spray nozzles 106 are mounted in a front forward facing portion of manifold 104. A center spray nozzle 106*a* is mounted in T-shaped coupler 122. Spray nozzles 106 and 106*a* provide a spray pattern directed toward the underlying surface and which overlap thereon when handle member 102 is held at a predetermined angular relationship to the underlying surface to be cleaned. Nozzles 106 and 106*a* that extend laterally the length of manifold 104 provide a continuous spray jet of water.

Support means comprising a pair of casters 128 is mounted on opposing ends of a support member 130 below manifold 104. Support member 130 is attached to the linear ground facing portion of elbow joint 118. Manifold 104 is maintained at a constant position above the underlying surface as the operator maneuvers water broom 100 therearound. Other manners for mounting casters and/or rollers 128 are contemplated and within the scope of the invention.

A water sweeper or broom 100 has been disclosed which is collapsible from an extended position to a retracted position to reduce the amount of space required to store water broom 100 or display at the point of sale. Furthermore, water broom 100 is self-supported on an underlying surface to be cleaned and provides a continuous spray pattern across the width of the broom 100.

Various aspects of any of the embodiments can be combined in different combinations than the ones shown to create new embodiments that fall within the scope of the appended claims. It is understood that the disclosed water broom 100 may be used to dispense hot or cold water with or without detergent, or to dispense any other cleaning solvent or chemical solution when fabricated of appropriate materials.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising."

What is claimed is:

1. A surface cleaning apparatus to connect to a liquid source under pressure and disperse liquid onto a surface to remove debris from the surface, the apparatus comprising:

a handle member having a liquid passage therethrough, the handle member being combinable to the liquid source for directing the liquid under pressure from the liquid source through the handle member;

a coupler combined to an end of the handle member and having a right side port and a left side port each in fluid communication with the liquid passage in the handle member;

a right flow joint with an internal passage combined to the right side port of the coupler for providing for fluid communication from the coupler through the right flow joint;

a left flow joint with an internal passage combined to the left side port of the coupler for providing for fluid communication from the coupler through the left flow joint;

a right side manifold section combined to the right flow joint, wherein the right side manifold section is moveable from an extended position to a retracted position and the internal passage in the right flow joint opens and closes as the right side manifold section moves;

a left side manifold section combined to the left flow joint, wherein the left side manifold section is moveable from an extended position to a retracted position and the internal passage in the left flow joint opens and closes as the left side manifold section moves;

and a plurality of nozzles spaced apart and positioned along the right side manifold section and the left side manifold section, wherein liquid in the right side manifold section and the left side manifold section is directed out the nozzles toward the surface to remove the debris from the surface.

2. The apparatus of claim 1, wherein the handle member is a telescoping elongated handle member that moves telescopingly between an extended position to a retracted position.

3. The apparatus of claim 2, wherein the extended position of the manifold defines a maximum width for the apparatus and the retracted position defines a minimum width for the apparatus, the minimum width being a storage position for the apparatus.

4. The apparatus of claim 3, and further comprising at least one roller combined to the manifold and positioned behind a direction of flow of the liquid under pressure from the nozzles to the surface so as not to disrupt the flow of the liquid to the surface, wherein the roller engages a ground surface to facilitate movement of the apparatus across the ground surface as liquid under pressure is directed out of the nozzles to the surface for moving debris across the surface.

5. The apparatus of claim 4, wherein the manifold is movable with respect to the ground surface to change the position of the nozzles with respect to the ground surface for adjusting an angle with respect to the ground surface the direction of flow of the liquid under pressure travels.

6. The apparatus of claim 5, and further comprising a manually operated lever combined to the handle member to manually control the flow of liquid out of the handle.

7. The apparatus of claim 1, wherein the handle member comprises a base member and a foldable member pivotally combined to the base member and moveable in a semicircular arc between an extended position and a retracted position parallel to the base member.

8. The apparatus of claim 7, wherein the extended position of the manifold defines a maximum width for the apparatus and the retracted position defines a minimum width for the apparatus, the minimum width being a storage position for the apparatus.

9. The apparatus of claim 8, and further comprising at least one roller combined to the manifold and positioned behind a direction of flow of the liquid under pressure from the nozzles to the surface so as not to disrupt the flow of the liquid to the surface, wherein the roller engages a ground surface to facilitate movement of the apparatus across the ground surface as liquid under pressure is directed out of the nozzles to the surface for moving debris across the surface.

10. The apparatus of claim 9, wherein a telescoping manifold is movable with respect to the ground surface to change the position of the nozzles with respect to the ground surface for adjusting an angle with respect to the ground surface the direction of flow of the liquid under pressure travels.

11. The apparatus of claim 10, and further comprising a manually operated lever combined to the handle member to manually control the flow of liquid out of the handle.

12. A surface cleaning apparatus to connect to a liquid source under pressure and disperse liquid on to a surface to remove debris from the surface, the apparatus comprising:

a handle member having a liquid passage therethrough, the handle member being combinable to the liquid source for directing the liquid under pressure from the liquid source through the handle member;

a manifold having a right and a left section wherein each section is pivotally combined substantially perpendicularly to the handle member such that each section extends outward with respect to the handle member, the right and left sections rotate between an extended position and a retracted position parallel with the handle member, each section having a cross liquid passage therethrough in fluid communication with the liquid passage that opens and closes as the right and left section of the manifold moves between the extended position and retracted position; and a plurality of nozzles spaced apart and positioned along the manifold, wherein liquid in the manifold is directed out the nozzles toward the surface to remove the debris from the surface.

13. The apparatus of claim 12, wherein the handle member is a telescoping elongated handle member that moves telescopingly between an extended position to a retracted position.

14. The apparatus of claim 12, wherein the handle member is a foldable handle member that comprises a base member and a foldable member pivotally combined to the base member and moveable in a semicircular arc between an extended position and a retracted position parallel to the base member.

15. The apparatus of claim 12, and further comprising a pivoting coupling combining each section of the manifold to the handle member, the pivoting couplings have an internal passage in fluid communication with the cross liquid passage of each section of the manifold when the section of the manifold are in the extended position and the internal passage being closed when the section of the manifold are in the retracted position.

16. The apparatus of claim 12, and further comprising a sliding coupling on the handle member and two support members on opposite sides of the sliding coupling and extending to each section of the manifold to move the section of the manifold to the retracted position when the sliding coupling is moved up the handle member.

17. A surface cleaning apparatus to connect to a liquid source under pressure and disperse liquid on to a surface to remove debris from the surface, the apparatus comprising:

a handle member having a liquid passage therethrough, the handle member being combinable to the liquid source for directing the liquid under pressure from the liquid source through the handle member;

a manifold having a right and a left section wherein each section is pivotally combined substantially perpendicularly to the handle member such that each section extends outward with respect to the handle member, the right and left sections rotate between an extended position and a retracted position parallel with the handle member, each section having a cross liquid passage therethrough in fluid communication with the liquid passage;

a pivoting coupling combining each section of the manifold to the handle member, the pivoting couplings have an internal passage in fluid communication with the cross liquid passage of each section of the manifold when the section of the manifold are in the extended position and the internal passage being closed when the section of the manifold are in the retracted position; and a plurality of nozzles spaced apart and positioned along the manifold, wherein liquid in the manifold is directed out the nozzles toward the surface to remove the debris from the surface.

18. The apparatus of claim 17, and further comprising a sliding coupling on the handle member and two support members on opposite sides of the sliding coupling and extending to each section of the manifold to move the section of the manifold to the retracted position when the sliding coupling is moved up the handle member.

19. A surface cleaning apparatus to connect to a liquid source under pressure and disperse liquid on to a surface to remove debris from the surface, the apparatus comprising:

a handle member having a liquid passage therethrough, the handle member being combinable to the liquid source for directing the liquid under pressure from the liquid source through the handle member;

a manifold having a right and a left section wherein each section is pivotally combined substantially perpendicularly to the handle member such that each section extends outward with respect to the handle member, the right and left sections rotate between an extended position and a retracted position parallel with the handle member, each section having a cross liquid passage therethrough in fluid communication with the liquid passage that open and close as each section of the manifold move between the extended position and the retracted position;

a sliding coupling overlapping the handle member and moveable with respect to the handle member, wherein the right and left section of the manifold are secured to the sliding coupling when the right and left section of the manifold are in the retracted position;

and a plurality of nozzles spaced apart and positioned along the manifold, wherein liquid in the manifold is directed out the nozzles toward the surface to remove the debris from the surface.

* * * * *